US005377661A

United States Patent [19]

Farver

[11] Patent Number: 5,377,661

[45] Date of Patent: Jan. 3, 1995

[54] WOOD BURNING STOVE FOR HEATING WATER

[76] Inventor: Donald L. Farver, 242 Highmeadow Rd., Reisterstown, Md. 21136

[21] Appl. No.: 165,674

[22] Filed: Dec. 13, 1993

[51] Int. Cl.[6] ..... F24D 7/00

[52] U.S. Cl. ..... 126/101; 126/65; 126/362; 122/209.1; 122/367.1; 237/56

[58] Field of Search ..... 126/101, 65, 361, 362, 126/513, 289; 122/367.1, 176, 264, 202, 209.1, 15; 237/66.52, 61, 62, 18, 16, 59, 56

[56] References Cited

U.S. PATENT DOCUMENTS

| | | | |
|---|---|---|---|
| 815,839 | 3/1906 | Jones et al. | 126/101 |
| 3,934,554 | 1/1976 | Carlson | 122/176 |
| 4,516,563 | 5/1985 | De Larm | 126/101 |
| 4,724,798 | 2/1988 | Alspaugh | 126/101 |
| 4,779,795 | 10/1988 | Winmill | 126/101 |
| 5,036,829 | 8/1991 | Woo | 126/101 |

*Primary Examiner*—James C. Yeung

[57] ABSTRACT

A stove for the generation of heat from the burning of wood for heating water and for heating the room in which it is located comprising a drum having cylindrical side walls about a horizontal axis, support legs and circular end walls; an array of tubes including a water input tube and a water output tube, the tubes extending through one end wall, the tubes interior of the drum including a rectangular array in a horizontal configuration adjacent to the widest part of the drum and coupled to the water input tube, the tubes interior of the drum also including an array of semicircular tubes extending upwardly from the rectangular array about the axis of the drum, the tubes interior of the drum also including a linear output tube parallel with the axis of the drum coupled to the topmost part of the semicircular tubes for discharging the heated water; a chimney coupled to the drum for conveying away smoke from interior of the drum; an air input tube with a damper and a thermostat for controlling the damper for determining the extent of opening of a damper to determine the heat output of the stove and heated water.

3 Claims, 2 Drawing Sheets

WOOD BURNING STOVE FOR HEATING WATER

BACKGROUND OF THE INVENTION

1. Field of the Invention

The present invention relates to a wood burning stove for heating water and more particularly pertains to a wood burning stove capable of heating both radiator water and potable water as well as the room in which it is located.

2. Description of the Prior Art

The use of wood burning stoves is known in the prior art. More specifically, wood burning stoves heretofore devised and utilized for the purpose of heating water, air and the like are known to consist basically of familiar, expected and obvious structural configurations, notwithstanding the myriad of designs encompassed by the crowded prior art which have been developed for the fulfillment of countless objectives and requirements.

Prior art efforts for improving stoves for heating water and additional functions are disclosed in the prior art. Note for example, U.S. Pat. Nos. 5,123,360 to Burke and 5,139,082 to Timpano which disclose fuel burning stoves with air flow means for increasing efficiency. In addition, U.S. Pat. Nos. 4,250,864 to Bergman and 4,534,319 to Manno disclose fuel burning stoves wherein the fuel is supported on tubes as for conveying water. The Manno device also includes a heat exchanger connected to a domestic hot water supply. Lastly, additional patents of interest are disclosed by Walsh in U.S. Pat. No. 4,261,329 and by Labigner in U.S. Pat. No. 4,467,959. The Walsh disclosure relates to a modular solar panel energy system while Labigner teaches mechanisms adjacent the flue of a stove for providing heat to a room in which it is located.

In this respect, the wood burning stove for heating water according to the present invention substantially departs from the conventional concepts and designs of the prior art, and in so doing provides an apparatus primarily developed for the purpose of heating radiator water, potable water, air and the like.

Therefore, it can be appreciated that there exists a continuing need for new and improved wood burning stove for heating water. In this regard, the present invention substantially fulfills this need.

SUMMARY OF THE INVENTION

In view of the foregoing disadvantages inherent in the known types of stoves now present in the prior art, the present invention provides an improved wood burning stove for heating water. As such, the general purpose of the present invention, which will be described subsequently in greater detail, is to provide a new and improved wood burning stove for heating water and the method which has all the advantages of the prior art and none of the disadvantages.

To attain this, the present invention essentially comprises a stove for the generation of heat from the burning of wood for heating radiator water and for heating the room in which it is located comprising, in combination, a drum having cylindrical side walls about a horizontal axis, support legs and circular end walls with a door in one end wall for the introduction of scrap wood to be burned and for the removal of ashes therefrom, the drum having a tray for supporting the scrap wood to be burned and the ashes resulting therefrom; an array of tubes including a water input tube and a water output tube couplable with respect to radiators exterior of the drum, the tubes extending through the end wall opposite from the door to interior of the drum, the tubes interior of the drum including a rectangular array in a horizontal configuration adjacent to the widest part of the drum and coupled to the water input tube, the tubes interior of the drum also including an array of semicircular tubes extending upwardly from the rectangular array about the axis of the drum, the tubes interior of the drum also including a linear output tube parallel with the axis of the drum coupled to the topmost part of the semicircular tubes for discharging the heated water; a chimney coupled to the drum for conveying away smoke from interior of the drum; an air input tube with a damper and a thermostat for controlling the damper for determining the extent of opening of the damper to determine the heat output of the stove and heated water.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wood burning stove for heating water which has all the advantages of the prior art stoves and none of the disadvantages.

It is another object of the present invention to provide a new and improved wood burning stove for heating water which may be easily and efficiently manufactured and marketed.

It is a further object of the present invention to provide a new and improved wood burning stove for heating water which is of a durable and reliable construction.

An even further object of the present invention is to provide a new and improved wood burning stove for heating water which is susceptible of a low cost of manufacture with regard to both materials and labor, and which accordingly is then susceptible of low prices of sale to the consuming public, thereby making such a wood burning stove for heating radiator water economically available to the buying public.

Still yet another object of the present invention is to provide a new and improved wood burning stove for heating water which provides in the apparatuses and methods of the prior art some of the advantages thereof, while simultaneously overcoming some of the disadvantages normally associated therewith.

Still another object of the present invention is to heat a house and its water with scrap wood safely, efficiently and economically.

Yet another object of the present invention is to convert scrap wood into heat energy for heating radiator water, potable water, air and the like.

Even still another object of the present invention is to provide a new and improved stove for the generation of heat from the burning of wood for heating water and for heating the room in which it is located comprising a drum having cylindrical side walls about a horizontal axis, support legs and circular end walls; an array of tubes including a water input tube and a water output tube, the tubes extending through one end wall the tubes interior of the drum including a rectangular array in a horizontal configuration adjacent to the widest part of the drum and coupled to the water input tube, the tubes interior of the drum also including an array of semicircular tubes extending upwardly from the rectangular array about the axis of the drum, the tubes interior of the drum also including a linear output tube parallel with the axis of the drum coupled to the topmost part of the semicircular tubes for discharging the heated water; a chimney coupled to the drum for conveying away smoke from interior of the drum; an air input tube with a damper and a thermostat for controlling the damper for determining the extent of opening of a damper to determine the heat output of the stove and heated water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
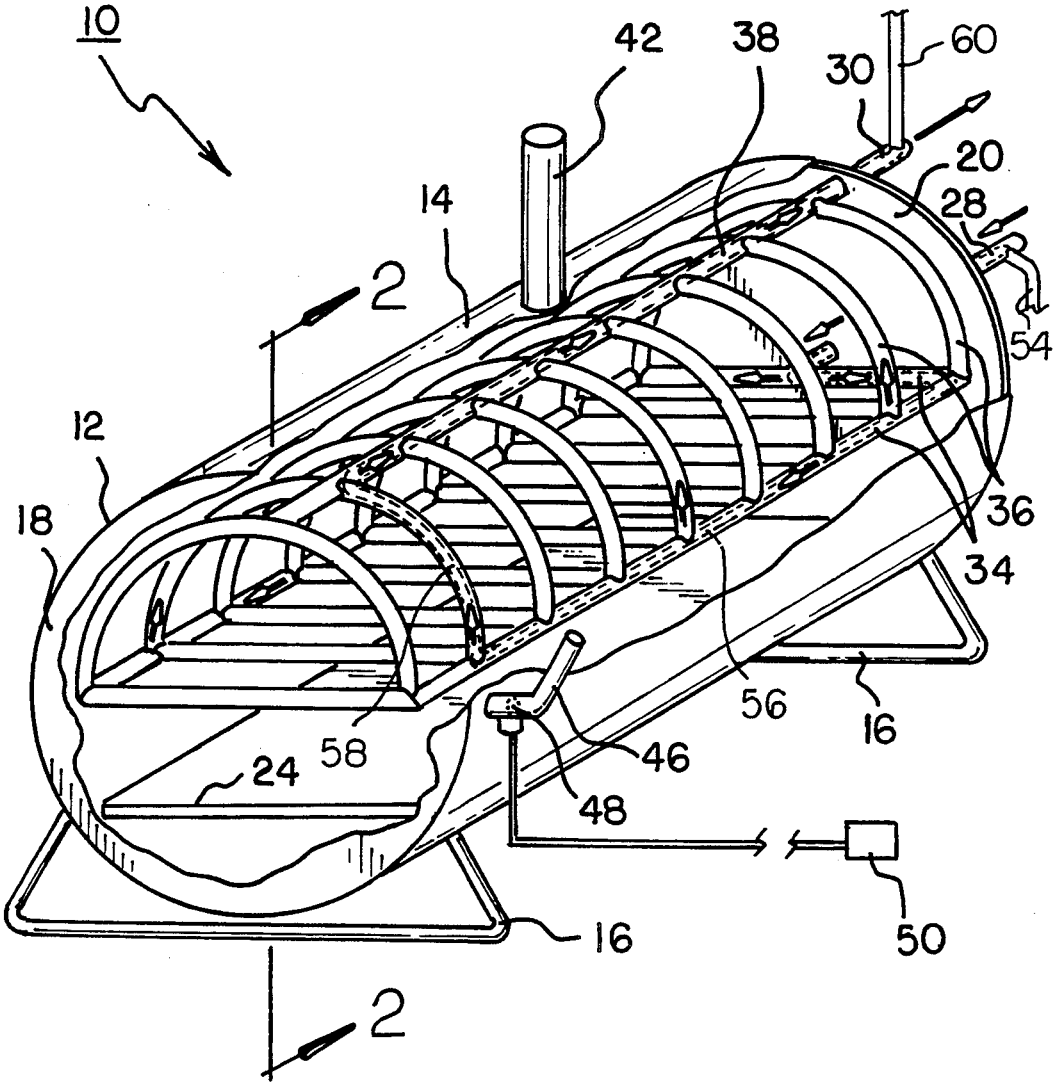
FIG. 1 is perspective illustration of a wood burning stove for heating water constructed in accordance with the principles of the present invention.

With reference now to the drawings, and in particular to FIG. 1 thereof, a new and improved wood burning stove for heating radiator water embodying the principles and concepts of the present invention and generally designated by the reference numeral 10 will be described.

Figure 2:
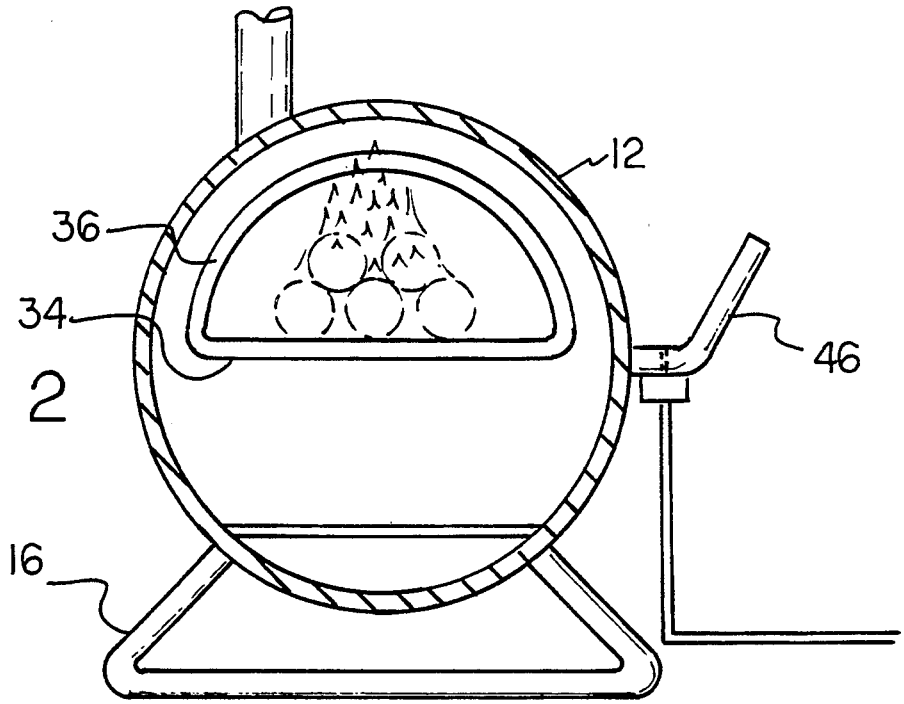
FIG. 2 is a sectional view of the stove taken along line 2 to FIG. 1.
Figure 3:
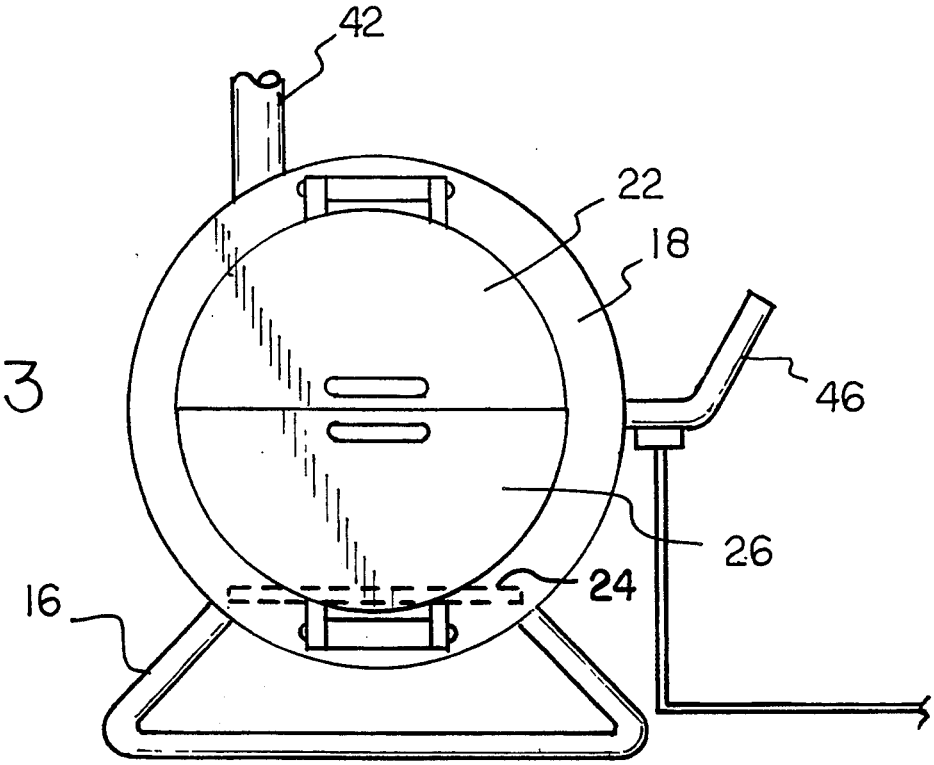
FIG. 3 is a side elevational view of the apparatus of FIGS. 1 and 2.

More specifically, it will be noted that the stove 10 is for the generation of heat from the burning of wood for heating water and for heating the room in which it is located. The stove comprises a drum 12 which has cylindrical side walls 14 oriented and supported about a horizontal axis. Support legs 16 depend therefrom. Circular end walls 18 and 20 are provided. A door 22 is formed in the upper half of one end wall 18 for the introduction of scrap wood to be burned onto the horizontal pipes. A tray 24 is located at a lower extent of the drum for supporting the ashes. A second door 26 is formed in the lower half of the end wall 18 beneath the first door 22. The second door 26 is for the removal of ashes from the tray 24. Note FIGS. 2 and 3.

An array of tubes is provided for conveying water to be heated. Such tubes include a water input tube 28 and a water output tube 30. These tubes extend to radiators exterior of the drum. Such tubes extend through the end wall 20 opposite from the door 22.

The tubes interior of the drum include a rectangular array 34 in a horizontal configuration adjacent to the widest part of the drum. The rectangular array 34 is coupled to the water input tube 28. The tubes interior of the drum also including an array of semicircular tubes 36 extending upwardly from the rectangular array in parallel alignment about the axis of the drum 12. The tubes interior of the drum also including a linear output tube 38. The output tube is parallel with the axis of the drum at the topmost part of the semicircular tubes. The output tube 34 functions to discharge the heated water from the drum.

Coupled to an upper extent of the drum 12 is a chimney 42. The chimney 42 is coupled to the drum for conveying away smoke from interior of the drum.

An air input tube 46 is located at one side of the drum. The tube is provided with a damper 48 interiorly thereof. A thermostat 50 is coupled to the damper for controlling the damper. The thermostat functions for determining the extent of opening up a damper allowing air to the drum 12 to determine the heat output of the stove and heated water.

In addition to heating water for radiators which heat space in a house, the stove 10 of the present invention also can heat the potable water of the house. A copper domestic cold water inlet line 54 of copper tubing is located adjacent to water input tube 28 and extends therethrough. Inlet line 54 extends within tube 28 horizontally along the length of the horizontal array 34, up the endmost semicircular tube 36, back horizontally along output tube 38 and then through output tube 30. Where it emerges as the domestic hot water is outlet 60. The copper line 54, 56, 58, 60 heats the potable water flowing therethrough by the heat of the fire in the furnace as well as by being in heat exchanging relationship with the radiator water flowing through the array of tubes from the input tube 28 to the output tube 30. The copper tubing is of sufficiently small size so as to allow radiator water to flow over and around the copper tubing for maximum heat transfer while achieving its objective of heating both radiator water and potable water as well as heating the air in the room where the stove is located.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stove for the generation of heat from the burning of wood for heating radiator water and for heating the room in which it is located comprising, in combination:

a drum having cylindrical side walls about a horizontal axis, support legs and circular end walls with a door in one end wall for the introduction of scrap wood to be burned and for the removal of ashes therefrom, the drum having a tray for supporting the scrap wood to be burned and the ashes resulting therefrom;

an array of tubes including a water input tube and a water output tube couplable with respect to radiators exterior of the drum, the tubes extending through the end wall opposite from the door to interior of the drum, the tubes interior of the drum including a rectangular array in a horizontal configuration adjacent to the widest part of the drum and coupled to the water input tube, the tubes interior of the drum also including an array of semicircular tubes extending upwardly from the rectangular array about the axis of the drum, the tubes interior of the drum also including a linear output tube parallel with the axis of the drum coupled to the topmost part of the semicircular tubes for discharging the heated water;

a chimney coupled to the drum for conveying away smoke from interior of the drum;

an air input tube with a damper and a thermostat for controlling the damper for determining the extent of opening of the damper to determine the heat output of the stove and heated water.

2. A stove for the generation of heat from the burning of fuel comprising:

a drum having cylindrical side walls about a horizontal axis, support legs and circular end walls;

an array of tubes including a water input tube and a water output tube, the tubes extending through one end wall the tubes interior of the drum including a rectangular array in a horizontal configuration adjacent to the widest part of the drum and coupled to the water input tube, the tubes interior of the drum also including an array of semicircular tubes extending upwardly from the rectangular array about the axis of the drum, the tubes interior of the drum also including a linear output tube parallel with the axis of the drum coupled to the topmost part of the semicircular tubes for discharging the heated water;

a chimney coupled to the drum for conveying away smoke from interior of the drum;

an air input tube with a damper and a thermostat for controlling the damper for determining the extent of opening of a damper to determine the heat output of the stove and heated water.

3. The stove as set forth in claim 2 and further including copper tubing within the array of tubes from the water input tube to the water output tube for the heating of potable domestic water.

* * * * *